United States Patent [19]

Sabraw

[11] Patent Number: 4,922,992

[45] Date of Patent: May 8, 1990

[54] MELT-HOLDING VESSEL AND METHOD OF AND APPARATUS FOR COUNTERGRAVITY CASTING

[75] Inventor: Richard J. Sabraw, Saginaw, Mich.

[73] Assignee: General Motors Corporation, Detroit, Mich.

[21] Appl. No.: 290,682

[22] Filed: Dec. 27, 1988

[51] Int. Cl.[5] ..... B22D 18/06; C21B 3/00

[52] U.S. Cl. ..... 164/63; 164/255; 164/335; 266/242; 266/275

[58] Field of Search ..... 164/63, 254, 255, 256, 164/258, 335, 337; 266/275, 242

[56] References Cited

U.S. PATENT DOCUMENTS

| | | | |
|---|---|---|---|
| 830,208 | 9/1906 | Colby | 266/275 X |
| 1,647,083 | 10/1927 | Croll | 266/283 X |
| 4,340,108 | 7/1982 | Chandley et al. | 164/63 |
| 4,399,981 | 8/1983 | Nömtak | 266/275 |
| 4,606,396 | 8/1986 | Chandley et al. | 164/255 |

FOREIGN PATENT DOCUMENTS

| | | | |
|---|---|---|---|
| 1504572 | 10/1967 | France | 266/275 |

*Primary Examiner*—Nicholas P. Godici
*Assistant Examiner*—J. Reed Batten, Jr.
*Attorney, Agent, or Firm*—Reising, Ethington, Barnard, Perry & Milton

[57] ABSTRACT

A melt-holding vessel includes a melt-holding chamber defined by a bottom wall and upstanding side wall of refractory material. The side wall includes one or more insulating air pockets located in such a manner relative to the chamber as to substantially reduce heat loss from the melt in the chamber by conduction through the side wall.

20 Claims, 1 Drawing Sheet

MELT-HOLDING VESSEL AND METHOD OF AND APPARATUS FOR COUNTERGRAVITY CASTING

FIELD OF THE INVENTION

The invention relates to a vessel for holding a melt, such as molten metal, and, more particularly, to an improved vessel for reducing heat loss from the melt by conduction through side walls of the vessel.

BACKGROUND OF THE INVENTION

A vacuum countergravity casting process using a gas permeable mold is described in such prior art patents as the Chandley et al U.S. Pat. Nos. 4,340,108 issued July 20, 1982 and 4,606,396 issued Aug. 19, 1986. That countergravity casting process involves providing a mold having a porous, gas permeable upper mold member (cope) and a lower mold member (drag) secured together, sealing a vacuum chamber to the mold such that the vacuum chamber confronts the gas permeable upper mold member, submerging the bottom side of the drag in ar underlying pool of molten metal and evacuating the vacuum chamber to draw the molten metal through one or more ingate passages in the drag and into one or more mold cavities formed between the cope and the drag.

In practicing that vacuum countergravity casting process, the molten metal pool typically is contained in a melt-holding vessel over an extended time period (e.g., about 5–10 minutes) as required to countergravity cast a plurality of molds in succession from the molten metal pool. Attempts by the inventor to hold a melt, such as a grey iron or a nodular iron melt, over such an extended time period have met with difficulties in maintaining the proper melt casting temperature. The particular melt-holding vessel used in these attempts included a steel support shell having an inner, solid refractory lining defining a cylindrical melt-holding chamber. A coreless induction coil disposed below the melt-holding vessel was continuously energized to inductively heat the melt in an attempt to maintain its temperature within the desired range for casting over the necessary extended time period. However, as a result of unexpectedly high heat loss from the melt by conduction through the refractory side wall of the vessel, the melt-holding vessel was incapable of maintaining the temperature of the grey iron or nodular iron melt within the desired range for the time period required to cast a plurality of molds in succession from the pool, even when the induction coil was energized continuously at its maximum power limit or rating (e.g., 840 kilowatts).

It is an object of the present invention to provide an improved melt-holding vessel having means for substantially reducing heat loss from the melt by conduction through the refractory side wall of the vessel to enable the temperature of the melt to be maintained within the desired range for casting with a reduced level of energy input to the melt.

It is another object of the invention to provide an improved method of casting a melt from a melt-holding vessel involving reducing conductive heat loss from the melt through the vessel ride wall to such an extent that the melt temperature can be maintained within the desired range for casting one or more molds over an extended time period.

SUMMARY OF THE INVENTION

The present invention contemplates a vessel for holding a melt wherein the vessel includes bottom wall means of refractory material and side wall means of refractory material for forming a chamber to receive the melt and wherein the side wall means includes insulating air pocket means located peripherally and vertically relative to the chamber to reduce heat loss from the melt by conduction through the side wall means.

In one embodiment of the invention, the insulating air pocket means is disposed in the side wall means at a vertical location near the level (height) of the melt in the chamber and may comprise a plurality of insulating air pockets located at peripheral locations about the chamber.

In another embodiment of the invention, the side wall means includes an inner refractory dam and a spaced apart outer refractory lining forming the insulating air pocket means therebetween. The inner refractory dam and the outer refractory lining preferably are disposed on the bottom wall means such that a lower end of the insulating air pocket means is closed off by the bottom wall means. An upper end of the insulating air pocket means is preferably closed off by a refractory cap disposed between the inner refractory dam and the outer refractory lining.

Although the invention is especially useful and advantageous in the vacuum countergravity casting of molten metal into a plurality of molds over an extended time period, it is not limited thereto and may find use in other melt-holding or melt-casting applications.

DETAILED DESCRIPTION OF THE INVENTION

Figure 1:
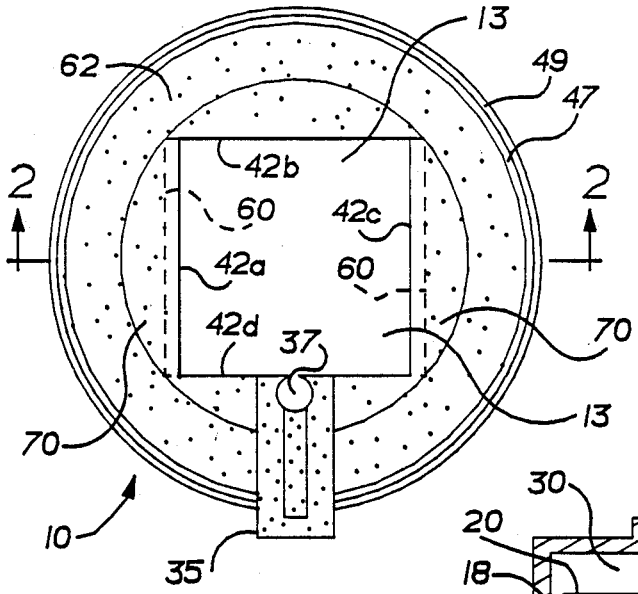
FIG. 1 is a plan view of a melt-holding vessel in accordance with the invention for use in the countergravity casting of a melt into a gas permeable mold.
Figure 2:
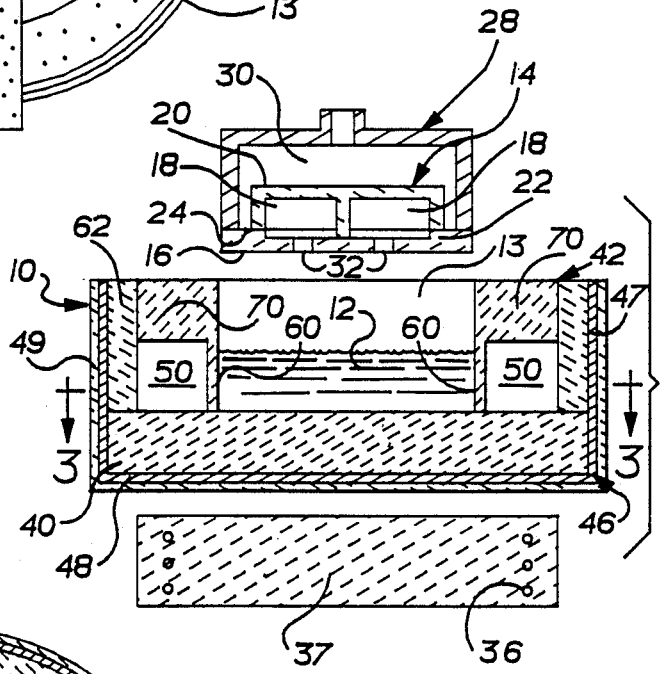
FIG. 2 is a longitudinal cross-sectional view of the melt-holding vessel along lines 2—2 of FIG. 1 with a gas permeable mold shown located above the vessel.
Figure 3:
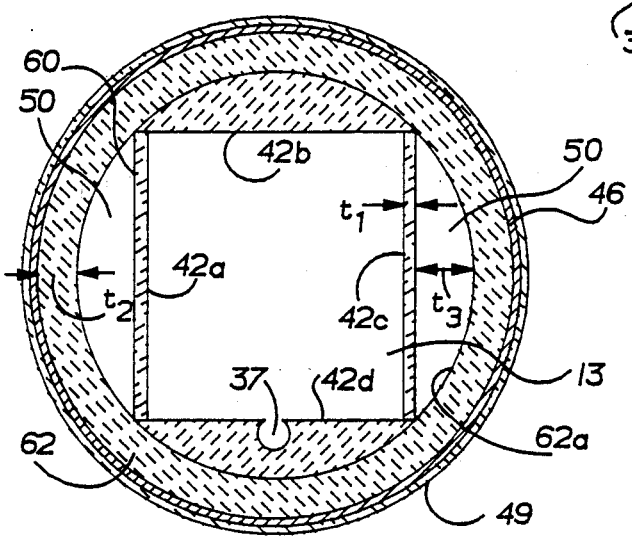
FIG. 3 is a cross-sectional view taken along lines 3—3 of FIG. 2.

FIGS. 1–3 illustrate a melt-holding vessel 10 in accordance with the invention for use in holding a melt 12 (e.g., molten metal) in a melt-holding chamber 13 while the melt is countergravity cast into a gas permeable mold 14 when the bottom side 16 of the mold is immersed in the melt 12 with the mold cavities 18 evacuated. The mold 14 includes a gas permeable cope 20 and a drag 22, which may be gas permeable or impermeable, sealingly engaged at a parting plane 24 and forming the mold cavities 18 therebetween. A vacuum housing 28 is sealed to the mold 14 such that a vacuum chamber 30 defined by the housing 28 confronts the gas permeable cope 20. When the bottom side 16 of the mold 14 is immersed in the melt 12 and the vacuum chamber 30 is evacuated, the melt 12 is drawn upwardly through bottom ingate passages 32 in the drag 22 and into the respective mold cavity 18 thereabove as explained in the Chandley et al U.S. Pat. Nos. 4,340,108 and 4,606,396. A suitable actuator means (not shown) described in the aforementioned Chandley et al patents is used to lower the mold 14 and the vacuum housing 28 toward the melt 12 to immerse the bottom side 16 in the melt 12. After the mold cavities 18 are filled with the melt 12, the mold 14 is raised out of the melt 12 and moved to a casting removal station (not shown) in accordance with conventional practice.

This sequence is repeated for a plurality of molds 14 to cast them one after another from the melt 12. During this casting sequence, the melt 12 is periodically inductively heated to maintain its temperature within a desired range for casting. To this end, an induction coil 36 is disposed beneath the vessel 10 on a ceramic support 37.

When the level of the melt 12 in the chamber 13 drops to a preset lower level after casting a number of molds 14, additional melt 12 is supplied to the chamber 13 from a melting or holding furnace (not shown) to return the melt level to its original level (height) as will be explained hereinbelow. Thereafter additional molds 14 are cast in succession from the melt 12.

A melt-holding vessel 10 in accordance with the present invention includes a horizontal bottom wall means 40 of refractory material and an upstanding (e.g., substantially vertical) side wall means 42 of refractory material. The bottom wall means 40 and the vertical wall means 42 define the melt-holding chamber 13. The upstanding side wall means 42 includes substantially vertical, planar, inner sides 42*a*,42*b*,42*c*,42*d* defining a parallelogram-shaped (e.g., square) chamber 13 when viewed in horizontal cross-section as shown in FIG. 3. The refractory material of the bottom wall means 40 and the side wall means 42 is selected to be resistant to the destructive effects of the particular melt 12 in contact therewith. When the melt 12 comprises grey iron or nodular iron, a conventional high alumina refractory material in the form of bricks and/or a moldable plasticized composition (e.g., a high alumina refractory particulate mixed with a plastic material) has proved useful.

The bottom wall means 40 and the upstanding side wall means 42 are supported in a cup-shaped outer metal (e.g., steel) support shell 46 having a cylindrical vertical side wall 47 and a horizontal bottom wall 48. An outer thermal insulation jacket 49 of fibrous ceramic material is provided exteriorly about the support shell 46.

As shown best in FIGS. 2 and 3, the upstanding side wall means 42 includes insulating air pockets 50. The insulating air pockets 50 are located in the side wall means 42 peripherally and vertically relative to the melt-holding chamber 13 to substantially reduce heat loss from the melt 12 by conduction through the side wall means 42. In particular, the insulating air pockets 50 are located at spaced apart peripheral locations adjacent the opposite sides 42*a*,42*c* of the side wall means 42 and at a vertical location near the level of the melt 12 in the chamber 13 to reduce conductive heat loss from the melt 12. The peripheral and vertical locations as well as number and configuration of the insulating air pockets 50 can be selected as needed to reduce heat loss from the melt 12 in the chamber 13 to acceptable levels.

As shown in FIGS. 2 and 3, each insulating air pocket 50 is formed between an inner refractory dam 60 and a laterally spaced outer refractory lining 62 of the side wall means 42. The inner refractory dam 60 is in the form of substantially vertical, planar wall that subtends or closes off a substantially vertical, arcuate (circular arc) inner side 62*a* of the outer refractory lining 62.

The lower end of each insulating air pocket 50 is closed off by the bottom wall means 40 while the upper end thereof is closed off by a refractory cap 70 formed atop and spanning from the inner refractory dam 60 the outer refractory lining 62. FIG. 2. The refractory cap 70 minimizes heat loss by radiation from the insulating air pocket means 50.

For purposes of illustration only, a melt-holding vessel 10 as shown in FIGS. 1-3 was constructed to hold molten grey iron at a temperature between about 2450° F. and about 2600° F. and also nodular iron at a temperature between about 2550° F. and about 2625° F. The melt-holding chamber 13 was square in horizontal cross-section (34 inches×34 inches) with a depth of about 17 inches to hold the melt 12 at a level (height) up to about 8 inches. The inner refractory dam 60 and the outer refractory lining 62 were formed with a thickness $t_1$ of about 2 inches and a thickness $t_2$ of about 4 inches, respectively. Each insulating air pocket 50 was disposed adjacent the opposite sides 42*a*,42*c* of the side wall means 42 as shown in FIGS. 2 and 3 and had a maximum gap $t_3$ of about 8 inches and a height of about 9 inches. The bottom wall means 40 was 10 inches in thickness.

Such a melt-holding vessel 10 was used to hold a grey iron melt (1200 lbs.) as the melt was vacuum countergravity cast into a plurality of gas permeable molds 14 in succession over a period of about 60 minutes. The temperature of the melt was readily controlled within the desired temperature range (e.g., about 2450° F. to about 2600° F.) by continuous, but reduced energization of the induction coil 36 at a fraction (i.e., 75%) of its maximum power rating (i.e., 840 kilowatts). The same vessel 10 was subsequently employed to hold a nodular iron melt (1200 lbs.) for vacuum countergravity casting into a plurality of gas permeable molds 14 in succession over a period of 60 minutes. During casting, the temperature of the melt was readily controlled within the desired temperature range of about 2550° F. to about 2625° F. for nodular iron by continuous energization of the induction coil 36 at a fraction (i.e., 75%) of its maximum power rating. In these casting trials, the flux pattern generated by the energized induction coil 36 was controlled in such a manner as to prevent substantial heating of the support shell 46 when the melt 12 (either the grey iron or nodular iron) was inductively heated.

As a result of the substantial reduction in heat loss from the melt 12 in the chamber 13 attributable to the presence of the insulating air pockets 50 in the side wall means 42, the above described energization of the induction coil 36 in the aforesaid casting trials was effective in maintaining the grey iron melt within its desired casting temperature range and also in maintaining the nodular iron melt within its higher desired casting temperature range during the extended time period required to cast the molds. The same melt-holding vessel 10 thus can be used to cast grey iron melts and nodular iron melts at their optimum casting temperatures. Moreover, less energy input on the melt 12 was required to maintain its temperature in the desired range over a given time period required to cast the molds.

In fabricating the melt-holding vessel described in the illustrative example set forth above, the outer refractory lining 62 was first formed by laying high alumina refractory bricks about the inner circumference of the vertical side wall 47 of support shell 46 to a height corresponding generally to the height of the wall 47. The bricks were mortared using a suitable high alumina refractory plastic material. The inner dams 60 were then built up to the desired height using mortared high alumina refractory bricks and/or high alumina refractory plastic material hand molded to shape. A destructible plastic foam board pattern having the desired shape of the insulating air pockets 50 was then laid between each inner dam 60 and the outer refractory lining 62 and a high alumina refractory plastic material was rammed on the inner dams 60 and outer refractory lining 62 to form the refractory caps 70 and the vertical walls 42*a*,42*b*,42*c*,42*d* to the desired height shown in FIG. 2. The rammed refractory was then heated to impart the required structural integrity thereto and to vaporize the plastic foam board.

The melt-holding vessel was then preheated to an elevated temperature in preparation for receiving the melt 12. The melt 12 was poured into a pour spout 35 disposed on the side wall means 42 and flowed down through a vertical fill channel 37 formed in the side 42*d* to fill the melt-receiving chamber 13 to a desired melt level (height) for vacuum countergravity casting.

Although the melt-holding vessel 10 of the invention is described hereinabove for holding the melt 12 during the countergravity casting of one or more molds, those skilled in the art will appreciate that the vessel may be used myriad in other melt-holding or melt-casting applications with or without means for heating the melt 12.

Moreover, while the invention has been described in terms of certain specific embodiments thereof, it is not intended to be limited thereto but rather only to the extent set forth hereafter in the following claims.

I claim:

1. A vessel for holding a melt, comprising bottom wall means of refractory material and upstanding side wall means of refractory material for forming a chamber to hold the melt, said side wall means including insulating air pocket means located peripherally and vertically relative to said chamber for reducing heat loss from the melt in said chamber by conduction through said side wall means.

2. The vessel of claim 1 wherein said insulating air pocket means is disposed in said side wall means at a vertical location near the level of the melt in said chamber.

3. The vessel of claim 2 wherein said insulating air pocket means comprises a plurality of insulating air pockets disposed in said side wall means at peripheral locations about said chamber.

4. The vessel of claim 1 further including means for heating the melt.

5. A vessel for holding a melt, comprising bottom wall means of refractory material and upstanding side wall means of refractory material for forming a chamber to hold the melt at a given level therein, said side wall means including (a) an inner side forming an outer periphery of the chamber and an outer side and (b) insulating air pocket means between the inner side and outer side and disposed at least partially about the periphery of said chamber at a vertical location near the level of the melt in said chamber for reducing heat loss from the melt by conduction through said side wall means.

6. The vessel of claim 5 wherein said side wall means includes an inner refractory dam and a spaced apart outer refractory lining defining said insulating air pocket means therebetween.

7. The vessel of claim 6 wherein the inner refractory dam comprises a planar, substantially vertical wall and said outer refractory lining comprises an arcuate, substantially vertical wall having an inner side subtended by said planar, substantially vertical wall.

8. The vessel of claim 6 wherein said inner refractory dam and outer refractory lining are disposed on said bottom wall means such that a lower end of the insulating air pocket means is closed off by said bottom wall means.

9. The vessel of claim 8 wherein an upper end of the insulating air pocket means is closed off by a refractory cap disposed between said inner refractory dam and said outer refractory lining.

10. The vessel of claim 5 wherein said chamber is configured in the form of a parallelogram when viewed in horizontal cross-section.

11. The vessel of claim 10 wherein said insulating air pocket means comprises a first air pocket adjacent one side of said parallelogram and a second air pocket adjacent an opposite side of said parallelogram.

12. The vessel of claim 5 further including an outer support shell disposed about the bottom wall means and side wall means.

13. The vessel of claim 5 further including means for heating the melt.

14. A vacuum countergravity casting apparatus, comprising:

(a) a gas permeable mold having a mold cavity and a bottom ingate passage for admitting molten metal to the mold cavity, (b) a molten metal holding vessel underlying said mold, said vessel comprising bottom wall means of refractory material and upstanding side wall means of refractory material for forming a chamber to hold the molten metal, said side wall means including insulating air pocket means located peripherally and vertically relative to the chamber for reducing heat loss from the melt by conduction throughout the side wall means, (c) means for relatively moving the mold and the vessel to position the mold in the chamber with the bottom ingate passage immersed in the melt, and (d) means by evacuating the mold cavity when the bottom ingate passage is immersed in the melt to urge the melt upwardly into the mold cavity.

15. The apparatus of claim 14 including means for heating the melt.

16. A method of casting a melt, comprising:

(a) holding the melt in a chamber formed by bottom wall means of refractory material and upstanding side wall means of refractory material, (b) maintaining the temperature of the melt in said chamber within a desired temperature range for casting into a mold, including locating insulating air pocket means in said side wall means peripherally and vertically relative to the chamber for reducing heat loss from the melt by conduction through said side wall means, and (c) casting the melt into the mold.

17. The method of claim 16 including locating the insulating air pocket means at a vertical location in the side wall means near the level of the melt in said chamber.

18. The method of claim 17 including providing a plurality of insulating air pocket means at spaced apart peripheral locations about said chamber.

19. A method of countergravity casting of a melt, comprising:

(a) holding the melt in a chamber formed by bottom wall means of refractory material and upstanding side wall means of refractory material, (b) immersing a plurality of gas permeable molds in succession in the melt while evacuating a mold cavity in each mold when it is immersed in the melt so as to cast the melt upwardly through a bottom ingate passage into the mold cavity of each mold, and (c) maintaining the temperature of the melt within a desired temperature range for casting as the molds are cast in succession from said melt, including locating insulating air pocket means in said side wall means peripherally and vertically relative to the chamber for reducing heat loss from the melt by conduction through said side wall means.

20. The method of claim 19 including heating the melt in step (c).

* * * * *

UNITED STATES PATENT AND TRADEMARK OFFICE

CERTIFICATE OF CORRECTION

PATENT NO. : 4,922,992

DATED : May 8, 1990

INVENTOR(S) : Richard J. Sabraw

It is certified that error appears in the above-identified patent and that said Letters Patent is hereby corrected as shown below:

In the specification:

Column 1, line 24, delete "ar" and insert --an-- therefor.
Column 4, line 1, after "60" insert --to--.

Signed and Sealed this

Twenty-fourth Day of December, 1991

*Attest:*

HARRY F. MANBECK, JR.

*Attesting Officer*

*Commissioner of Patents and Trademarks*